United States Patent [19]

Schellmann et al.

[11] 4,241,709

[45] Dec. 30, 1980

[54] DEVICE FOR ADJUSTING THE IGNITION TIME IN INTERNAL COMBUSTION ENGINES

[75] Inventors: Klaus Schellmann, Hemmingen; Heinz Schulze, Stuttgart, both of Fed. Rep. of Germany

[73] Assignee: Dr. Ing. h.c.F. Porsche Aktiengesellschaft, Fed. Rep. of Germany

[21] Appl. No.: 32,501

[22] Filed: Apr. 23, 1979

[30] Foreign Application Priority Data

Apr. 27, 1978 [DE] Fed. Rep. of Germany ..... 2818469

[51] Int. Cl.[3] ..... F02P 5/08; F02P 5/10

[52] U.S. Cl. ..... 123/407; 123/421; 123/146.5 A

[58] Field of Search ..... 123/117 R, 117 A, 146.5 A, 123/119 ED, 179 BG

[56] References Cited

U.S. PATENT DOCUMENTS

| | | | |
|---|---|---|---|
| 3,426,737 | 2/1969 | Walker | 123/117 A |
| 3,543,738 | 12/1970 | Barber et al. | 123/117 R |
| 3,665,904 | 5/1972 | Goodwillie | 123/117 A |
| 3,828,743 | 8/1974 | Ludwig | 123/117 R |
| 3,978,831 | 9/1976 | Yoshikawa | 123/117 A |
| 4,016,844 | 8/1977 | Tanaka et al. | 123/117 A |

FOREIGN PATENT DOCUMENTS

| | | | |
|---|---|---|---|
| 2552321 | 1/1977 | Fed. Rep. of Germany | 123/117 A |

*Primary Examiner*—P. S. Lall

*Attorney, Agent, or Firm*—Craig & Antonelli

[57] ABSTRACT

A device for the adjustment of the ignition time of an internal combustion engine as a function of the vacuum in the intake line which is provided with a flow regulator in the form of a throttle valve or the like.

9 Claims, 1 Drawing Figure

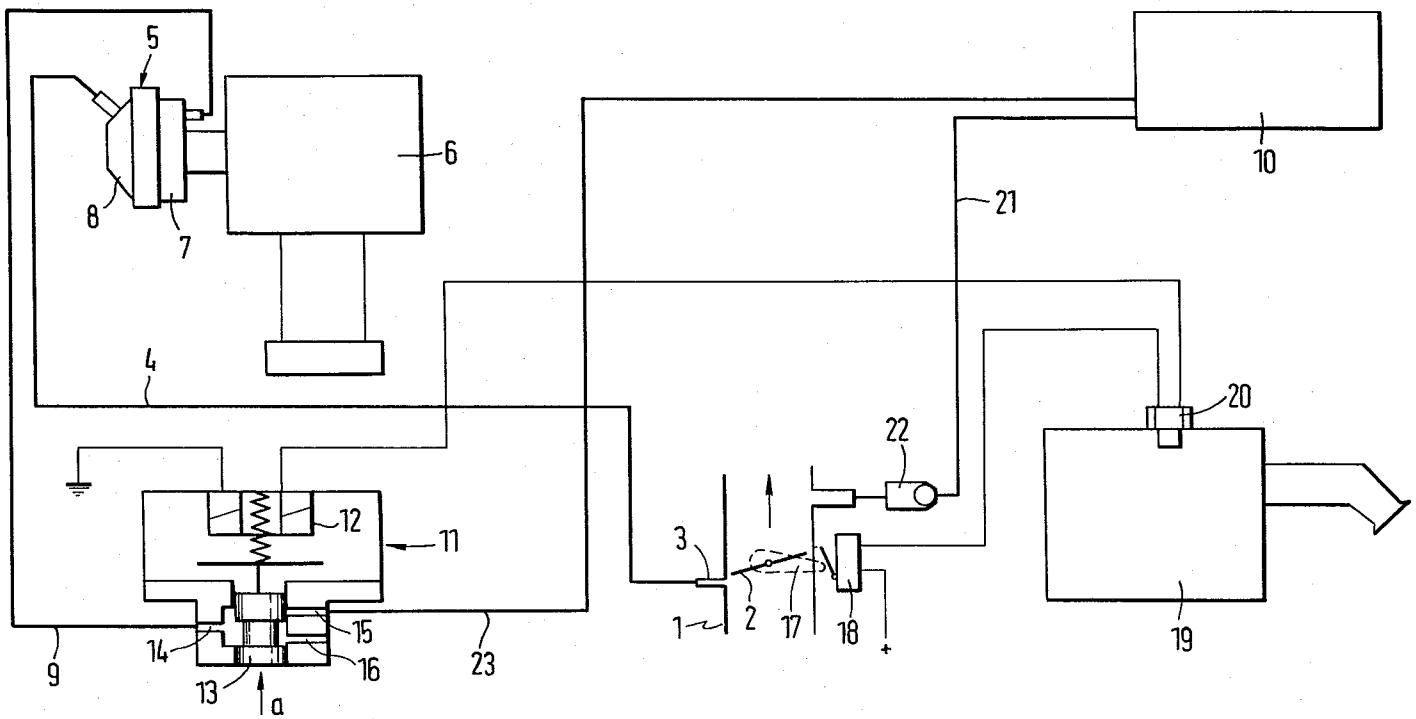
10
20
19
21
22
18
+
17
2
3
1
23
6
11
12
15
16
a
13
14
7
5
8
4
9

DEVICE FOR ADJUSTING THE IGNITION TIME IN INTERNAL COMBUSTION ENGINES

BACKGROUND OF THE INVENTION

The present invention relates to a device for adjustment of the ignition time in internal combustion engines as a function of the vacuum in the intake line which has a flow regulator such as, for example, a throttle valve and further including a vacuum device comprising a distributor advance chamber and a distributor retarding chamber.

In current automobile ignition systems, it is conventional to delay ignition time in order to reduce harmful exhaust substances, such as hydrocarbons and $NO_x$. However, a delay in ignition time results in both lower thermal efficiency and lower engine productivity, with a consequent impairment of engine performance. This impairment of engine performance is particularly evident with cold ambient conditions and in engine warm-up.

It is already known, German Patent No. 596,918, that better combustion with a cold engine can be obtained by advancing the ignition. Ignition advance toward normal ignition can be adjusted as a function of a predetermined engine temperature, but an internal combustion engine provided with such an ignition timing arrangement cannot be driven at maximum power due to the knocking combustion region that is encountered early.

In a warmed-up internal combustion engine, the knock threshold depends upon ambient conditions, particularly the temperature of the air intake and air pressure. The margin of safety between full-load ignition and the knock threshold must be adapted to the most unfavorable ambient conditions that can be expected to occur as a whole in the operation of the internal combustion engine. Thus, in the average set of ambient conditions, the maximally useable output of the internal combustion engine is less than desired.

SUMMARY OF THE INVENTION

It is an object of the present invention to provide a means for adjustment of internal combustion engine ignition time which optimizes timing adjustment. The problems encountered in the prior art have been solved by providing means whereby adjustment of ignition time is influenced by intake air temperature.

By the adjustment of ignition time as a function of intake air temperature, it has been found possible to come closer to the knock threshold with full-load ignition characteristics than was possible previously so that the maximally useful output of the internal combustion engine is increased without changing the ignition time in the partial load or idling range.

We have found it to be particularly advantageous if the adjustment means includes a thermo-switch that is influenced by intake air temperature, a throttle switch which is actuatable as a function of the flow regulator position, and a control valve that influences the vacuum means. More specifically, the control valve in accordance with one preferred embodiment of the present invention comprises a control piston actuatable by an electromagnet. The thermo-switch and the throttle valve switch are disposed in the electromagnet circuit. The control valve has throughput ports that are regulatable by the control piston. The distributor advance chamber of the vacuum device can be connected with a known vacuum ballast or vented through the ports of the control valve. The throttle valve switch can be actuated by a control cam that is fixed in rotation with the flow regulator, and the thermo-switch can be disposed in the air filter of the internal combustion engine.

BRIEF DESCRIPTION OF THE SOLE FIGURE

These and other features, objects, and advantages of the present invention will become more apparent from the following description when taken in conjunction with the sole FIGURE showing a preferred embodiment of the present invention.

DETAILED DESCRIPTION AND OPERATION OF A PREFERRED EMBODIMENT

Referring to the sole drawing FIGURE in which the internal combustion engine is not illustrated, there is shown a section of an intake line of the internal combustion engine designated by the numeral 1. A flow regulator, e.g. a throttle valve, is designated by the numeral 2 and is rotatably disposed in the intake line 1 and actuatable as desired. Intake air flows through the intake line 1 in the direction indicated by the arrow. The intake line 1 is connected to a vacuum device designated in general by the numeral 5 through a port 3 just above the illustrated idling position of the throttle valve 2 and a control pressure line 4 connected to the port 3.

The vacuum device 5 controls the ignition setting of a distributor 6 and includes a retard chamber 7 and an advance chamber 8 into which control line 4 opens. The retard chamber 7 is connected through vacuum lines 9 and 23 to a vacuum ballast 10. The line 9 is regulated by a control valve designated in general by the numeral 11 which comprises an electromagnet 12, a control piston 13, and throughput ports 14, 15 and 16. A throttle valve switch 18 is arranged in the circuit of the electromagnet 12 and is actuatable by a control cam 17 which is pivotable with flow regulator or throttle valve 2. A thermo-switch 20 is also arranged in the circuit of the electromagnet 12 and is fixed on the air filter 19 and influenced by the intake air.

The vacuum ballast chamber 10 is connected with another port (unnumbered) in the intake line in the region of the flow regulator 2 via a vacuum line 21. A control valve 22 is arranged in the vacuum line 21 in order to maintain the pressure in the vacuum ballast chamber 10 in a known fashion.

The operation of the above-described embodiment is as follows. When the internal combustion engine is driven and the temperature of the intake air is above the nominal switching point of thermo-switch 20 (for example at 20° to 25° C.), then the thermo-switch closes. Due to the continued rotation of the flow regulator or throttle valve 2, the vacuum increases in the vicinity of the port 3. As a result, the setting will be on advance, via the control pressure line 4 and the distributor advance chamber 8, while the retard chamber 7 will be vented via vacuum line 9 and throughput ports 14 and 16.

If the throttle valve 2 is turned from a position constituting the partial load range of the internal combustion engine first, the setting on the advance chamber 8 will be broken down by the pressure rise in the suction line. The throttle valve switch 18 will be actuated by the control cam 17 and the circuit for electromagnet 12 will become a closed circuit. As a result, the electromagnet 12 will pull the control piston 13 in the direction of arrow a until the throughput port 16, through which the retard chamber 7 is vented, closes and the throughput port 15 is opened. The distributor retard chamber 7 will then be connected with the vacuum ballast chamber 10 via vacuum line 9, ports 14 and 15, and vacuum line 23. The advance setting is thereby reduced by a value given in the retard chamber without, however, leaving the range of advanced ignition.

If the throttle valve 2 is again turned toward the range constituting partial load or beyond the partial load range in the direction of idling, the electromagnet circuit will be interrupted and the control piston 13 will move in the direction opposite to arrow a back into the position illustrated in the sole FIGURE. Then, throughput port 15 will close and the connection between the vacuum ballast chamber 10 and the retard chamber 7 will be interrupted. The retard chamber 7 will again be vented through vacuum line 9 and ports 14 and 16, and the distributor 6 will again move towards the advance ignition through control pressure line 4 and the port 3 as a function of the vacuum in the intake line 1.

When the internal combustion engine is driven and the temperature of the intake air is below the nominal switching point of the thermo-switch 20 (for example 20° to 25° C.), the thermo-switch 20 remains open and the circuit of electromagnet 12 is interrupted by the thermo-switch 20 and the throttle valve switch 18. With continued rotation of the throttle valve 2, the vacuum is increased in the vicinity of port 3 and the distributor advance chamber 8, and the distributor 6 is set on advance ignition. If, then, the throttle valve switch 18 is closed by the control cam 17, the circuit of the electromagnet 12 remains interrupted because of the open thermo-switch 20. Thus, with an air intake temperature below the switching point of the thermo-switch 20, there is no lessening or retardation of the advance ignition by the movement of the control piston 13 even if the throttle valve 2 has been turned beyond the setting that consitutes the partial load range of the engine.

While we have shown and described one preferred embodiment in accordance with the present invention, it is to be understood that modifications and changes may be made without departing from the scope of the present invention. For instance, the full load ignition setting can be influenced as a function of air pressure by means of a pressure chamber height regulator or in conjunction with the thermoswitch. Accordingly, we do not intend to be limited to the details shown and described herein, but intend to cover all such changes and modifications as are encompassed by the scope of the appended claims.

We claim:

1. Device for adjusting the ignition timing of an internal combustion engine comprising:

(a) a vacuum adjusting device having a distributor retard chamber and a distributor advance chamber for controlling ignition timing, said distributor advance chamber being in communication with intake vacuum in an air intake line;

(b) a vacuum chamber;

(c) a thermoswitch actuatable in response to the temperature of engine intake air exceeding a predetermined value;

(d) a throttle valve switch actuatable in response to a flow regulator means in said air intake line assuming a full or high load range position; and (e) control valve means for communicating said distributor retard chamber with ambient pressure in a first position thereof and for communicating said distributor retard chamber with said vacuum chamber upon conjoint actuation of both of said thermoswitch and throttle valve switch.

2. A device according to claim 1, wherein the control valve means includes a control piston, and an electromagnet means for actuating the control piston, said thermo-switch and said throttle valve switch being operatively associated with said electromagnet means.

3. A device according to claim 2, wherein the control valve means is provided with ports cooperating with the position of said control piston selectively to vent said distributor retard chamber or to connect said retard chamber with said vacuum chamber.

4. A device according to claim 1, wherein there is provided a control cam means operatively associated with said flow regulator means for actuating said throttle valve switch.

5. A device according to claim 1, wherein said thermo-switch is provided in an air filter of the internal combustion engine.

6. A device according to claim 5, wherein there is provided a control cam means operatively associated with said flow regulator means for actuating said throttle valve switch.

7. A device according to claim 6, wherein the control valve includes a control piston, and an electromagnet means for actuating the control piston, said thermoswitch and said throttle valve switch being operatively associated with said electromagnet means.

8. A device according to claim 7, wherein the control valve is provided with ports cooperating with the position of said control piston selectively to vent said distributor retard chamber or to connect said retard chamber with a vacuum ballast chamber.

9. Device for adjusting the ignition timing of an internal combustion engine as a function of intake vacuum in an intake line, provided with a flow-regulating element for the intake air of the internal combustion engine, by a vacuum-adjusting device comprising a distributor advance chamber and a distributor retard chamber, wherein said adjusting device comprises control means for adjusting the ignition timing as a function of the temperature of the intake air and full or high load conditions, the control means being formed by a thermoswitch, directly influenceable by the temperature of the intake air, a throttle flap switch actuatable as a function of the position of the flow-controlling element, and a control valve which influences the vacuum advance in cooperation with a vacuum chamber.

* * * * *